US012616282B2

(12) United States Patent
Ostanin

(10) Patent No.: US 12,616,282 B2
(45) Date of Patent: May 5, 2026

(54) ITEM OF JEWELERY

(71) Applicant: Aleksey Ostanin, Krasnogorsk (RU)

(72) Inventor: Aleksey Ostanin, Krasnogorsk (RU)

( * ) Notice: Subject to any disclaimer, the term of this patent is extended or adjusted under 35 U.S.C. 154(b) by 0 days.

(21) Appl. No.: 18/736,136

(22) Filed: Jun. 6, 2024

(65) Prior Publication Data

US 2025/0143421 A1 May 8, 2025

Related U.S. Application Data

(63) Continuation-in-part of application No. 18/500,869, filed on Nov. 2, 2023, now Pat. No. 12,004,613, which is a continuation of application No. 18/021,780, filed as application No. PCT/IB2021/053295 on Apr. 21, 2021.

(30) Foreign Application Priority Data

Jun. 19, 2020 (RU) ..... 2020120498

(51) Int. Cl.

| | |
|---|---|
| ***A44C 25/00*** | (2006.01) |
| ***A44C 5/00*** | (2006.01) |
| ***A44C 7/00*** | (2006.01) |
| ***A44C 9/00*** | (2006.01) |
| ***A44C 15/00*** | (2006.01) |
| ***A44C 17/02*** | (2006.01) |

(52) U.S. Cl.
CPC ..... *A44C 17/0208* (2013.01); *A44C 5/00* (2013.01); *A44C 7/00* (2013.01); *A44C 9/0015* (2013.01); *A44C 15/005* (2013.01)

(58) Field of Classification Search
CPC ..... A44C 25/001; A44C 25/007; A44C 17/02; A44C 17/0266; A44C 17/0275; A44C 7/00; A44C 7/002; A44C 9/003; A44C 17/0208; A44C 17/0216; A44C 9/0053; A44C 9/0007; A44C 9/0015; A44C 9/00
USPC ..... 63/15.1, 15.2, 15.4, 12, 13, 31
See application file for complete search history.

(56) References Cited

U.S. PATENT DOCUMENTS 4,869,078 A * 9/1989 Leith ..... A44C 7/00 63/13
12,042,028 B2 * 7/2024 Roi-Sanginario ..... A44C 17/0208

FOREIGN PATENT DOCUMENTS

JP 3242278 U * 6/2023

* cited by examiner

*Primary Examiner* — Jack W Lavinder
(74) *Attorney, Agent, or Firm* — CHERSKOV FLAYNIK & GURDA, LLC

(57) ABSTRACT

A system for reversibly mounting an object, the system comprising a base having a first region and a second region in rotatable communication with the first region such that in a first configuration, the regions are not coplanar and in a second configuration they are. Also provided is a system for removably mounting objects, the system comprising a base having a first end defining a first cross section; and a lever having a second end defining a second cross section, the lever in rotatable communication with the base such that in a first configuration, the ends are not aligned, and in a second configuration the lever is nested within the base such that the ends are aligned to form a continuous geometric shape defining an aperture adapted to receive a carrier.

5 Claims, 15 Drawing Sheets

Kind A

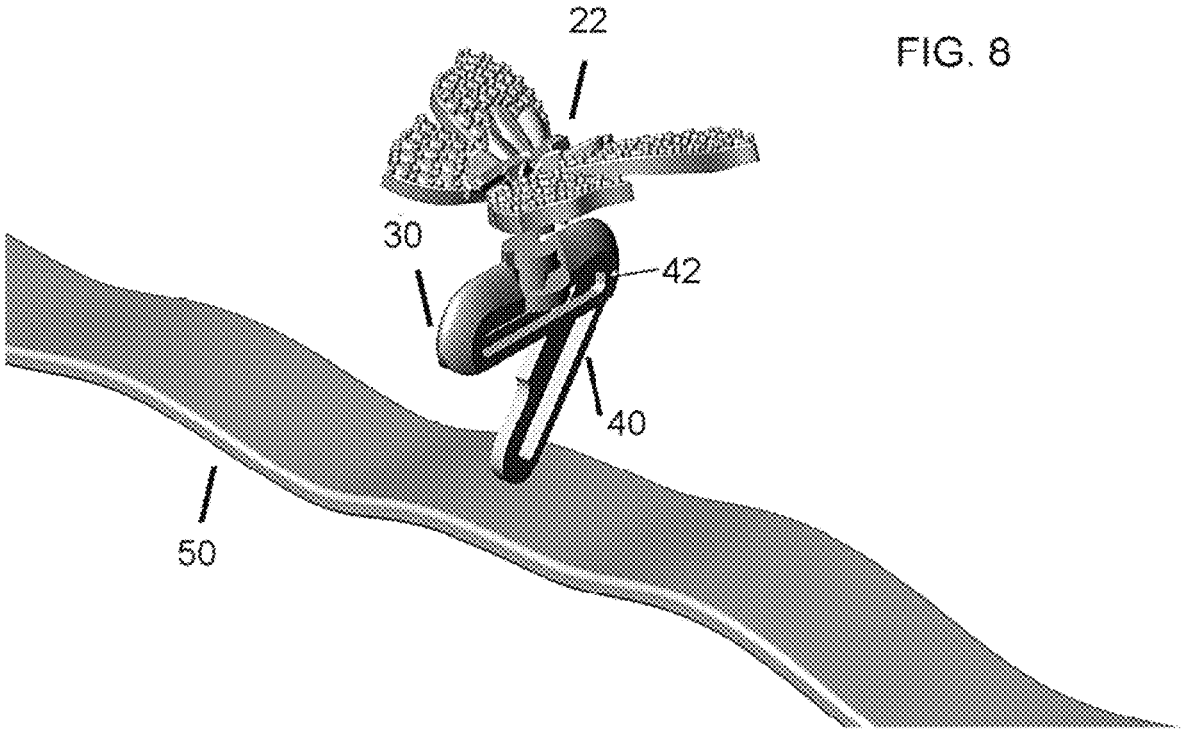
FIG. 8
FIG. 9
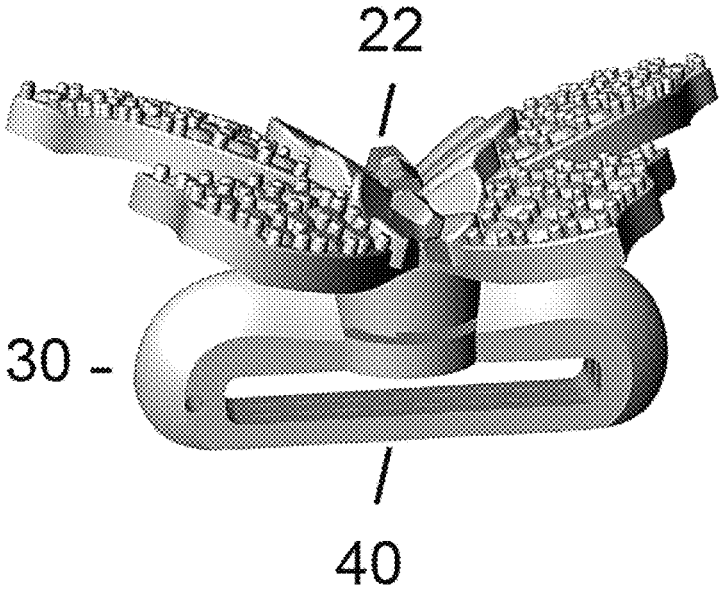

ITEM OF JEWELERY

PRIORITY

This Utility Patent Application is a Continuation in Part of U.S. patent application Ser. No. 18/500,869, filed on Nov. 2, 2023, currently pending, which is a Continuation of U.S. patent application Ser. No. 18/021,780, filed on Feb. 16, 2023, which, in turn, is a national state entry of the international application No. PCT/IB2021/053295, filed on Apr. 21, 2021, and claims priority to Russian patent application No. 2020120498, filed on Jun. 19, 2020, the entire contents of all of which are incorporated herein by reference.

BACKGROUND OF THE INVENTION

Field of the Invention

The invention relates to the reversible mounting of objects onto carriers, and more specifically, the invention relates to a method and system for reversibly mounting jewels and similar shaped objects onto carriers for display.

Background of the Invention

The display of jewels, pendants, lights, and other indicia takes on a myriad of forms. Typically, jewelry is permanently mounted onto a ring, a bracelet, or an elongated substrate. The mounting of several items on the same carrier (be it a ring, a bracelet, or an elongated substrate such as a necklace, or even an electrical conduit such as a wire or tape) is also typically done on a permanent mounting basis.

For example, a ring with a movable decorative jewel is known, including a body with an opening and a decorative jewel installed in it, containing a stand and a convex base, while the decorative Jewel is placed in the hole of the ring body in such a way that when the ring is put on the finger, the convex base of the said decorative Jewel, rests on the surface of the finger (see PI RF No. 2374964, A44C 9/00). In this case, the length of the post of the decorative Jewel is chosen more than the length of the hole in the ring body, and the diameter of the post is less than the diameter of the specified hole (see PI RF No. 2374964, A44C 9/00).

The disadvantage of the known design is its complexity and significant manufacturing costs. The decorative jewel is pre-installed in the conical cast of the rack, which is subsequently connected to the convex base through a blind hole. The connection is made within the inner cavity of the ring, which is known to be problematic. For the metals or jewels mentioned in this patent, the reference is made, for example, by welding or soldering. In addition, such labor leads to an increase in manufacturing costs.

Branded jewelry, which is a ringed jewel of a given external shape, with a central hole, on the outer surface of which a decorative jewel is fixed (see RF PM No. 26181, A44C 9/00). The ring-shaped jewel is assembled and includes a minimum of two flat plates, with a central hole located in each piece, located at a pre-determined distance from each other. The plates are interconnected by screws passing through the prefabricated holes in the plates located between the plates. For mounting the decorative jewel, sockets are made in the plates. Technical holes in the plates can be used to install decorative jewel inserts. The outer shape of the plates can be fabricated circular, trilateral, or four-sided with rounded corners, ovals or elliptical, with a flat cut of one of the surfaces for fixing decorative jewels.

The disadvantage of branded jewelry is the complexity of the design, requiring additional work when replacing the decorative jewel with a professional jeweler because unscrewing the screws involves the use of special tools. When removed, the entire piece of jewelry fragments into the jewels that make up the piece.

The impossibility of independent replacement of the decorative jewel directly by the user limits the possibilities of the artistic and aesthetic content of the jewelry.

The closest technical solution is a piece of jewelry containing a given shape of an annular jewel with a central hole, made prefabricated and including at least two main plates located at a distance from each other, fasteners passing through the technological gaps in the main plates, and the decorative jewel is situated in the nest (No. 127295 dated Nov. 8, 2012, A44C 9/00). In this case, the main plates are rigidly connected by a fabricated notch, in which a socket for the decorative jewel is made. Between the main plates of the annular jewel, at least one additional plate with a central hole and the prospect of contact with the decorative jewel is installed. The other plate is made with a prefabricated hole and is installed with the option of rotation around the axis of the fastener. To ensure the constant state of the jewel in the inoperative position, the plates are equipped with a relative position lock, parts of which are located on the main and additional plates.

The disadvantage of the technical solution is the excessive mobility of the decorative jewel in the nest and the need for additional costs to eliminate it. This is because the height of the decorative jewel differs from the height of the seat. In this situation, it is necessary to adjust all decorative jewels to the same height with an increased requirement for accuracy.

The aforementioned disadvantages related to rings are also experienced when dealing with bracelets, necklaces, and systems unrelated to jewelry such as the placement of ornaments and lights along a raceway or even in direct electrical communication with electrical conduits.

SUMMARY OF THE INVENTION

The technical problem to be resolved by the utility model is to increase the reliability of fixing a decorative jewel by eliminating its mobility and expanding the artistic and aesthetic significance of the jewelry.

The technical problem is solved by the fact that in a known piece of jewelry containing a decorative jewel located in a cast of a given shape, an annular jewel prefabricated by a central hole made in the form of two main plates, situated at a distance from each other and connected by a cylindrical boss, a fastener, an additional plate with a central hole and pivotally fixed on the main plate, an extra plate position lock. On the surface of the boss, there is at least one longitudinal groove and an annular connected to it; the cast is made hollow with a cylindrical inner surface, with the possibility of installation on it on the boss, and the inner surface there is at least one protrusion with the possibility of its placement in the grooves of the boss.

In addition, a recess is made on the end surface of the cast with the possibility of a part of the additional plate entering it.

Another object of the present invention is to provide a method and a system for reversibly mounting items to a carrier. A feature of the invention is a first position to secure the item to its base and a second position to secure the item-base construct to the carrier. An advantage of the invention is that the item remains secure to the carrier while the carrier (e.g., a bracelet or a pendant) is in service, for example while the carrier is being worn or supporting/displaying the item.

Yet another object of the present invention is to provide a system for reversibly mounting items to a carrier. A feature of the invention is a base for locking an item to it when the item is turned a certain arc length. Another feature of the invention is a coupling of the base to a carrier, wherein the coupling action prevents unlocking of the item. An advantage of the invention is that the item remains locked to the base as long as the coupling interacts with the carrier.

Briefly, the invention provides a system for mounting an object, the system comprising a base having a first region forming a first half of a support interaction surface such as a ring or plate; and a lever forming a complimentary second half of the support interaction surface in hingeable communication with the first half, wherein a second region of the base is in rotatable communication with the object such that in a first configuration, the first half is not coplanar with the second half and in a second configuration the first half is coplanar with the second half. In an embodiment of the invention, in the second configuration the second half is nested within the first half to form a ring adapted to receive a carrier such as an earring, pendant, bracelet, necklace such that the support interaction surface encircles the carrier.

Also provided is system for mounting discrete objects, the system comprising a base having a first end forming a first ring defining a first cross section; and a lever having a second end forming a second ring defining a second cross section, the lever in rotatable communication with the base such that in a first configuration, the first ring and the second ring are not aligned and in a second configuration the lever is nested within the base such that the second ring is coplanar with the first ring to form a loop, wherein the loop is adapted to receive a carrier.

BRIEF DESCRIPTION OF DRAWINGS

The invention, together with the above and other objects and advantages, will be best understood from the following detailed description of the preferred embodiment of the invention shown in the accompanying drawings, wherein:

FIG. 8 is a perspective view of a bracelet jewelry;

FIG. 9 is a view of the bracelet jewelry shown in FIG. 8 with the charm reversibly locked within its respective base, in accordance with features of the present invention;

DETAILED DESCRIPTION OF THE INVENTION

Figure 1A:
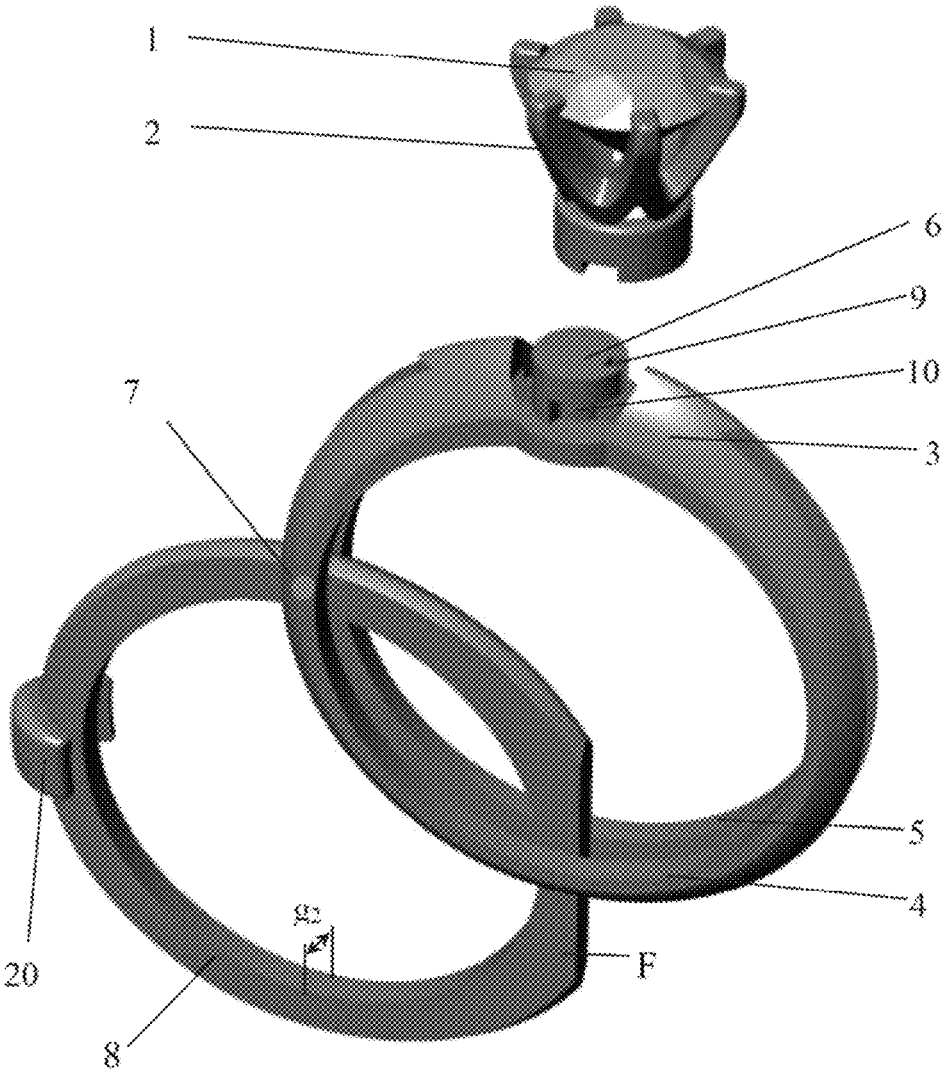
FIG. 1A is a perspective view of a ring jewelry before a cast is installed.

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant Figure.

The recitation of numerical ranges by endpoints includes all numbers within that range (e.g. 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invention provides a system and method for reversibly mounting objects to a support. General features of the invention include an object for mounting such as a light fixture, an electronic device (cell phone, camera) a charm (such as a diamond, pearl, or a whimsical piece), wherein the object reversibly mounts to a base. The object may have a first upwardly facing surface (defining the light fixture or charm) and a depending or downwardly facing surface which interacts with the base. One type of interaction is rotatable interaction where the object first contacts the base in a first position, then is rotated to a second position thereby preventing the object from separating from the base. This rotation can be done with a minimal amount of torque, so imposed manually by a person without the need for a tool.

The base comprises two regions which may be in rotatable or hingeable communication with each other. Each of the regions comprise complimentary surfaces of a mounting support structure such that when the regions are aligned, the support structure is adapted to receive a support, such as a raceway or a necklace. Once, so aligned, the base reversibly locks the object to the base. This alignment may be coplanar wherein opposing surfaces of the regions overlay each other, thereby forming the mounting support structure such as a ring, a plate, a boss or a clamp. Therefore, a first region defines a first surface of the mounting support structure that faces a direction opposite from a direction faced by a second surface of the second region; each region forming half of the whole mounting support structure.

When the support structure receives the support, the base may not be manipulated back to the first position. As such, the object cannot be removed from the base while the support structure is interacting with support.

Figure 2:
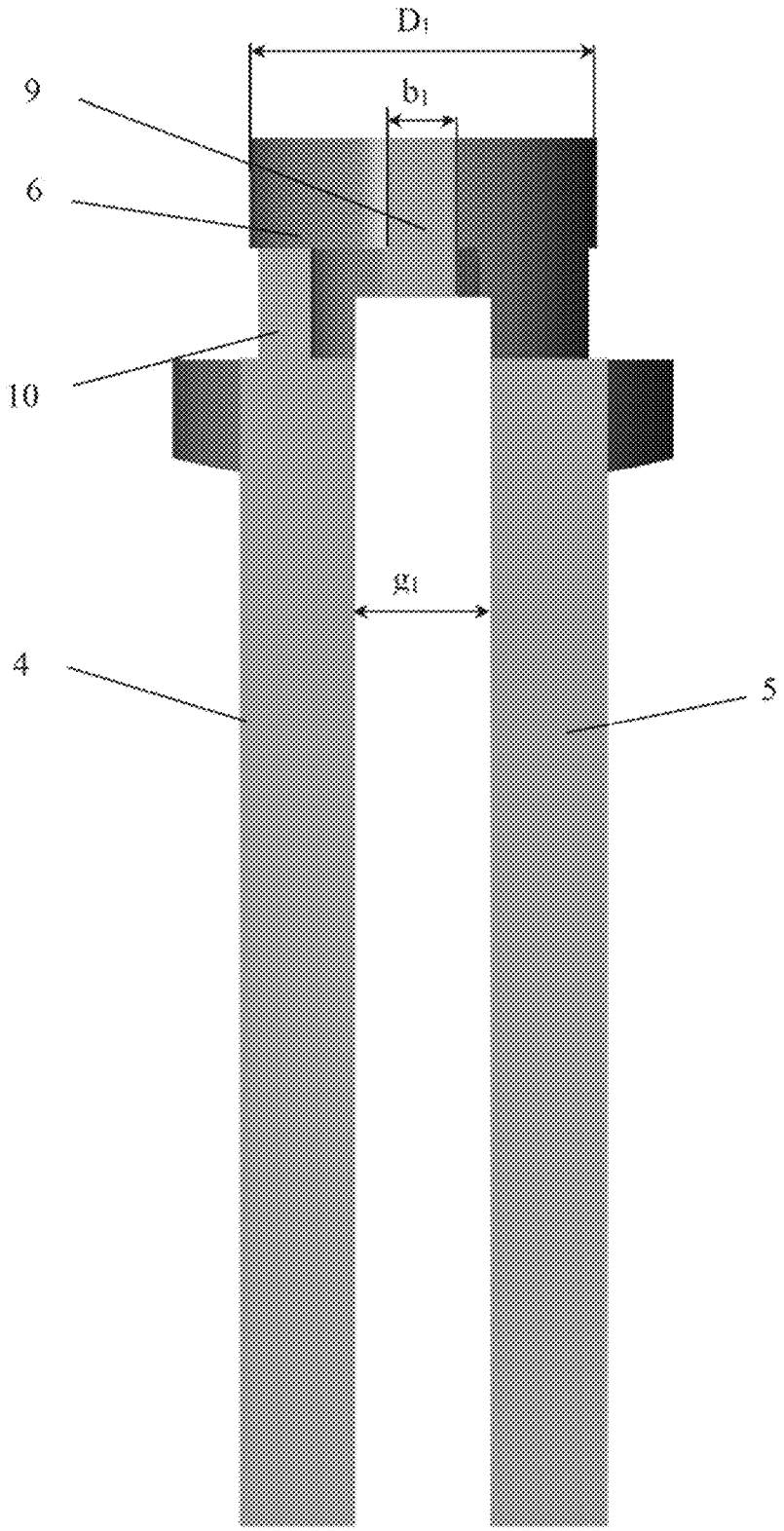
FIG. 2 is a cross-sectional view of a cast.
Figure 3:
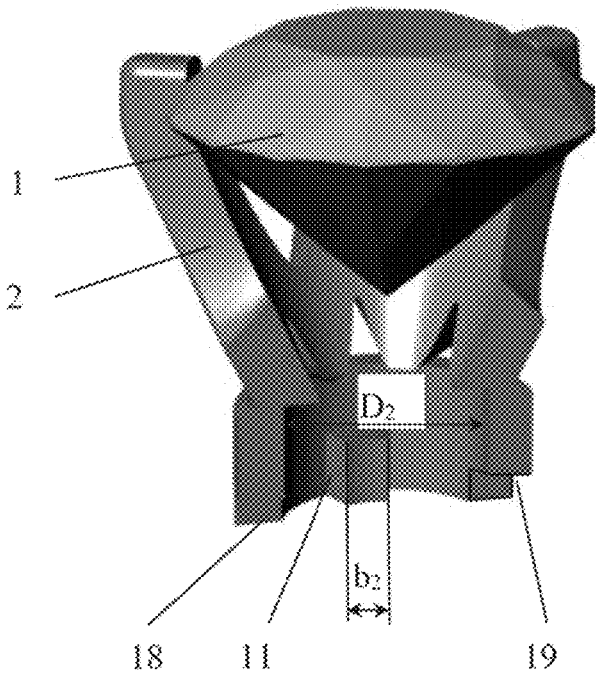
FIG. 3 is another cross-section view of a cast.
Figure 4:
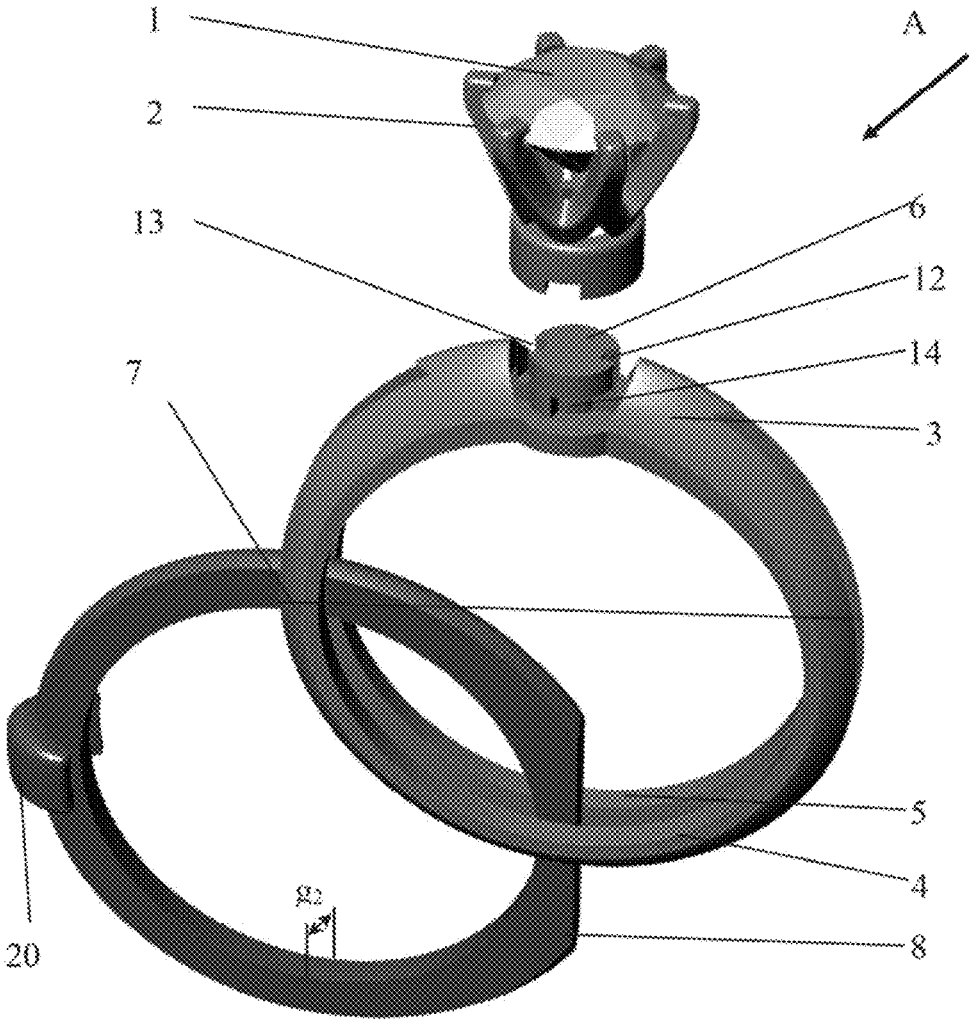
FIG. 4 is a cross-section view of an annular ring jewelry part.

The utility model is illustrated by graphic images, where FIG. 1A shows a general view of a charm 1 (e.g. jewelry) mounted to a cast 2. FIG. 2 shows a cross-section of a cast 2 without the charm so mounted. FIG. 3 is an elevated sectional view showing the Jewel in the cast. FIG. 4 is an exploded view of a variant of a jewelry.

Figure 5:
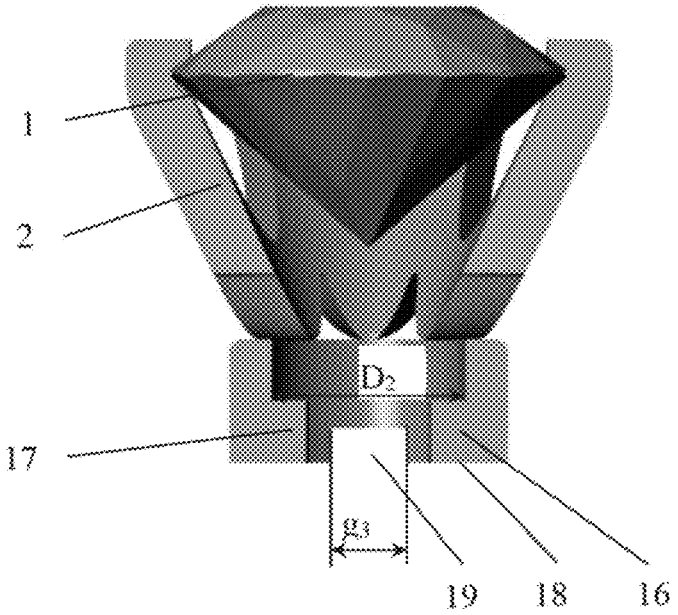
FIG. 5 is a cross-sectional view of a cast upon which a decorative item is placed, in accordance with features of the present invention.
Figure 6:
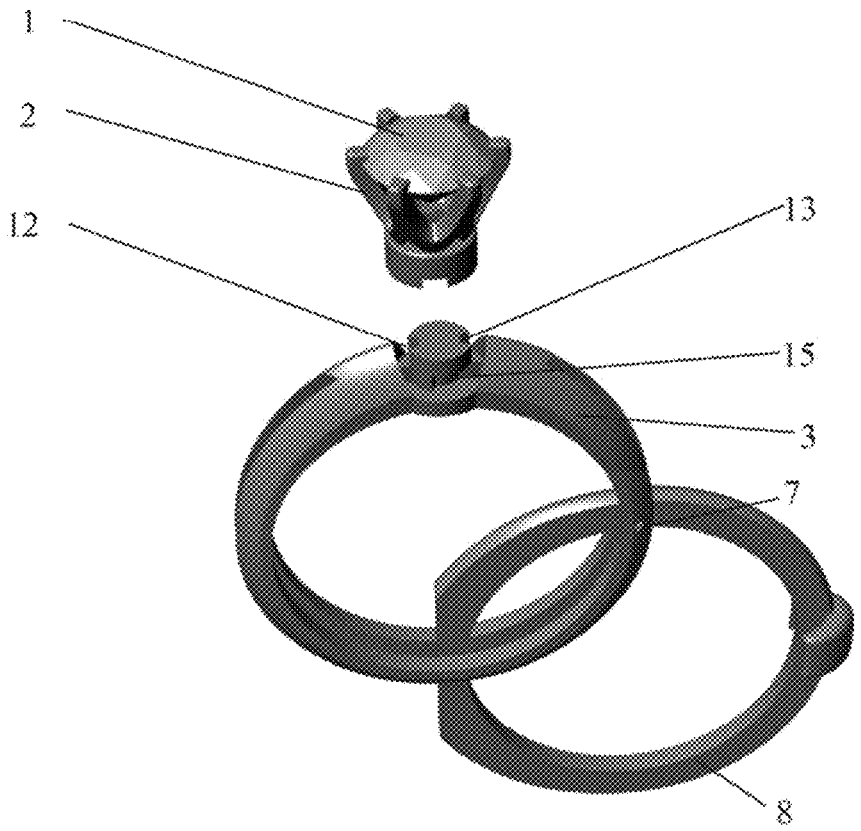
FIG. 6 is a perspective view of a ring jewelry.
Figure 7:
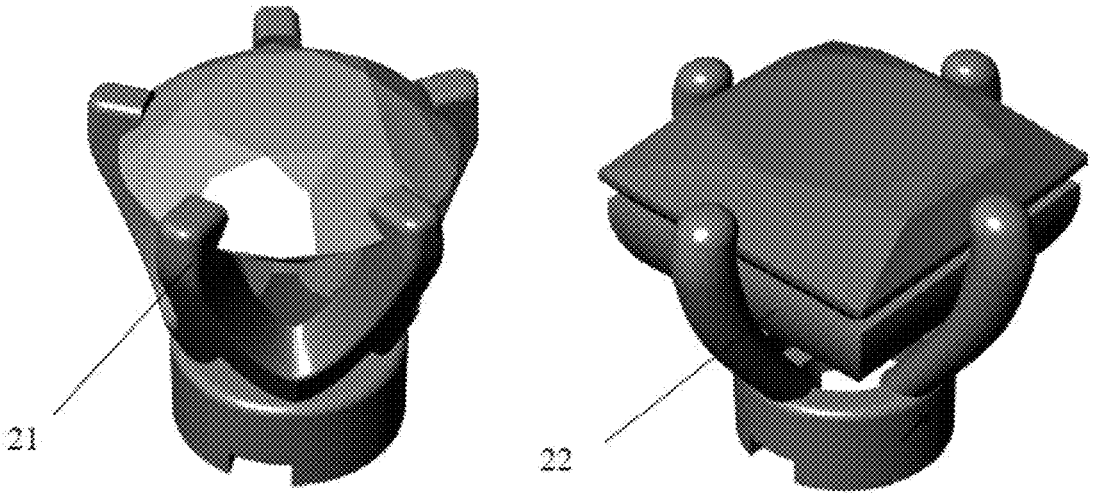
FIG. 7 shows variants of jewels installed in casts.

FIG. 5 is an elevated cross section of the cast 2, a depending region of same defining a mounting boss a charm 1 mounted to a variant with the execution of a decorative jewel in a cast (section). FIG. 6 is a view of FIG. 4 from direction A. FIG. 7 is a perspective view of a diamond or other charm mounted to a cast for ring jewelry.

The piece of jewelry contains a decorative Jewel (see FIG. 1B) installed in a cast "2" and an annular Jewel "3" (see FIG. 2). The piece of jewelry is completed with several interchangeable casts "2" with individual decorative jewels "1". Ring jewel "3", with a central hole, includes two main plates 4, 5 located at a distance from each other and connected between a cylindrical bead "6" with a diameter (FIG. 1A). An additional plate "8" with a central hole and thickness is fixed on the main plates, through the fastener 7. The plate "8" is fixed with the possibility of rotation about the axis of part 7 and freely passes between the main plates 4 and plates 5.

On the surface of the boss "6," there is a fabricated longitudinal groove "9" and an annular "10" connected to it (FIG. 2).

Cast "2" is made hollow, with a cylindrical inner surface of diameter (FIG. 3). The ratio of diameters provides a clearance fit. On the inner, cylindrical surface of cast "2", at least one protrusion is made with an outer dimension. The protrusion "11" due to the ratio of the dimensions, can move freely in the longitudinal groove "9" and the annular groove "10".

When two longitudinal grooves, for example, "12" and "13", are made, two annular grooves, "14" and "15", respectively connected to them, are made (FIG. 5). In this case, two protrusions "16" and "17" are made on the inner, cylindrical surface of cast 2" (FIG. 5). Wherein this simultaneous arrangement is ensured: the projection "16" in the longitudinal groove "12" and further annular "14", and the projection "17", respectively, in the longitudinal groove "13" and further annular "15".

In the end surface "18", cast "2", a recess "19" is made, with a width which is sufficient for the entry of a part of the additional plate "8" into it (FIG. 3).

In the working position, the additional plate "8" is rotated around the fastener 7 axis. The central holes of plates 4, "5," and "8" coincide. The plate "8" presses cast "2" through the surface "18" in the axial direction. When implementing the technical solution according to paragraph 2, part of plate "8" enters recess "19".

The main plates 4 and plate 5 and additional plate "8" can be equipped with a lock of their relative position "20" (FIG. 1A). The presence of the retainer "20" ensures that the position of the additional plate "8" remains unchanged relative to the main plates 4 and plate 5 in case of accidental loads on the jewelry when it is not positioned on the finger. For example, when a jewelry item falls from an elevation.

Decorative Jewel "1" only comes into contact with custom "2".

The piece of jewelry is finished with several removable casts, "21" and "22" (see FIGS. 6 and 7), with individual decorative jewels installed in them. All casts: 2, 21, and 22, are made with identical cylindrical surfaces with a diameter D1 and projections 11.

Figure 1B:
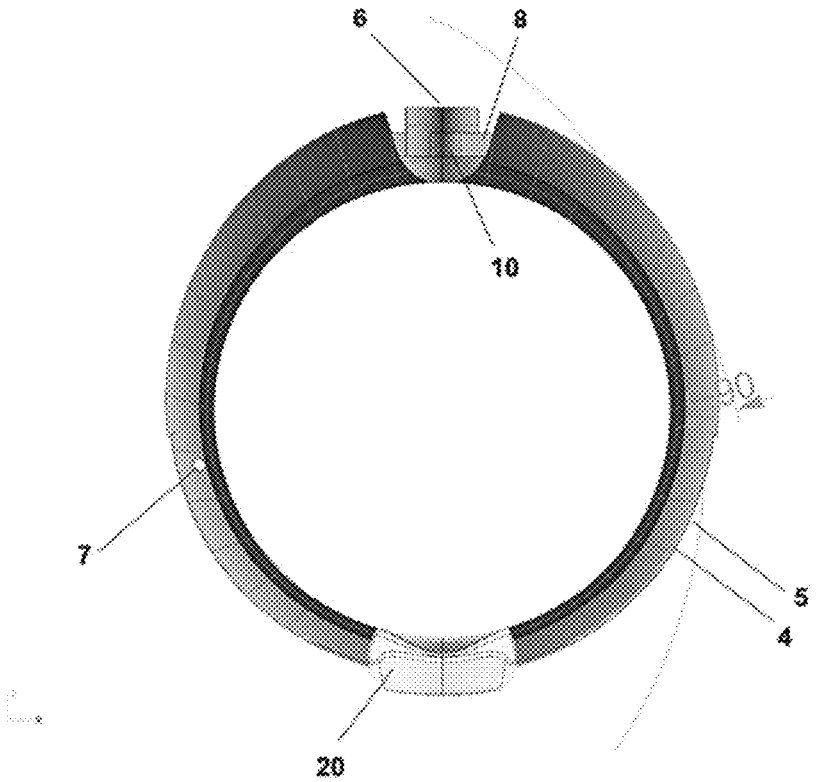
FIG. 1B is a cross section of a ring jewelry after cast mounting and rotation, and with a locking plate interacting with the cast, in accordance with features of the present invention.

When performing the variant with two protrusions "16" and "17" during the assembly of the jewelry, they similarly move in the longitudinal grooves "12" and "13" and then in the annular grooves "14" and "15". The further assembly process is similar to that performed in the presence of one protrusion "11". The piece of jewelry operates as follows (FIG. 1B). When implemented under the main claim of a utility model. decorative Jewel "1" is put into cast "2". The folding of the claws of cast "2" ensures adaptation to the actual size of decorative Jewel "1" and its reliable fixation in cast "2". The additional plate "8" is rotated around the axis of the fastener 7 so that its central hole and the central hole of the main plates 4 and plate 5 are separated (FIG. 1A).

Cast, "2" on a cylindrical surface with a diameter "D2", is installed on a cylindrical bead "6". The ratio of the diameters of the mating surfaces "D2>"D1" allows this to be done without difficulty. In this case, the projection "11" is located in the longitudinal groove "9". Cast "2" interchanges along the cylindrical bead "6" until projection "11" coincides with the annular groove 10. After that, the cast is rotated around the axis of the cylindrical bead "6". In this case, projection "11" moves along the annular groove "10". The walls of the annular groove "10" fix the projection "11" from movement along the axis of the boss "6". Fixation of the cast "2" from the exit from projection "11" is provided.

After the aforementioned rotation of the cast, the additional plate "8" is rotated around the axis of fastener 7 until its central hole coincides with the central holes of plates 4 and plates 5, as shown in FIG. 1B. A flat peripheral region F of the plate 8 contacts the end surface "18". This additionally protects cast "2" from turning around the axis of protrusion "11" and disconnecting from it. The jewelry now becomes ready to use.

The working position of plate "8" relative to plate 4 and plate 5 is additionally provided by latch "20". This allows the user to maintain the working position of the jewelry in case of accidental impacts outside of use on the finger.

The simplicity of the procedure for replacing the decorative jewel "1" in conjunction with custom "2" allows the user to perform it directly while using the jewelry. The presence of interchangeable casts "21" and casts "22" allows them to be replaced within a short duration, even while using the jewelry.

Thus, the claimed jewelry can now provide a more reliable fixation of the constituent jewels, primarily the decorative jewel "1". When altering it in the jewelry, the need for additional fitting is eliminated, and its quick replacement allows you to expand the artistic and aesthetic significance of the jewelry.

In addition to rings, the jewelry according to the disclosure may be applied to earrings, bracelets, necklaces, and other jewelries with jewels installed thereon.

The following description provides detail on a system and method for removably attaching an item to a carrier. The item may be a jewelry charm attached to a necklace or bracelet, a nacelle attached to a rigid raceway or other conduit, or a fixture attached to a flexible conduit such as a thermoplastic sheathed cable (e.g., Romex™ by Southwire Company, Carrollton, GA).

Three main components of this attachment system include an item 22 for display (e.g., fixture or charm), a base 30, and a base locking lever 40. The item 22 is securely attached to the base 30 when the base interacts with a support substrate 50.

The base 30 includes a first end, a second end, a top surface 32 and a bottom surface 34. A mid-point of the top surface 32 features a cylindrical boss 6 having a diameter. The bottom surface 34 defines a groove adapted to receive the locking lever 40. The lever is in rotatable communication with the bottom surface 34 via a pin 42 intersecting an end of the lever and an end of the base proximal to the end of the lever. The lever 40 freely passes through the groove to nest within the base in what is deemed herein as the item locking position.

As illustrated in FIG. 2, the surface of the boss 6 defines a fabricated longitudinal groove 9 and an annular channel 10 circumscribing the boss and extending in a direction that is perpendicular to the groove 9.

The item 22 is made hollow thereby forming a void, the void having a cylindrical inner surface of diameter (FIG. 3). The ratio of diameters provides a clearance fit. On the inner cylindrical surface of the item 22, at least one protrusion is made with an outer dimension. The protrusion 11 due to the ratio of the dimensions, can move freely in the longitudinal groove 9 and the annular groove 10.

When two longitudinal grooves, for example, 12 and 13, are made, two annular grooves, 14 and 15, respectively connected to them, are made (FIG. 5). Two protrusions 16 and 17 are made on the inner, cylindrical surface of item 22 (FIG. 5). Wherein this simultaneous arrangement is ensured: the projection 16 in the longitudinal groove 12 and further annular 14, and the projection 17, respectively, in the longitudinal groove 13 and further annular 15.

In the end surface 18, item 22, a recess 19 is made, with a width which is sufficient for the entry of a part of the additional plate 8 into it (FIG. 3).

In the working position, the locking lever "8" is rotated around the fastener 7 axis. The central holes of plates 4, 5, and 8 coincide. The plate 8 presses cast 2 through the surface 18 in the axial direction. When implementing the technical solution according to paragraph 2, part of plate 8 enters recess the 19.

The main plates 4 and plate 5 and additional plate "8" can be equipped with a lock of their relative position "20" (FIG. 1A). The presence of the retainer "20" ensures that the position of the additional plate "8" remains unchanged relative to the main plates 4 and plate 5 in case of accidental loads on the jewelry when it is not positioned on the finger. For example, when a jewelry item falls from an elevation.

FIG. 8 is an exploded view of a bracelet jewelry. In this view, the item (here a charm) 22 is shown detached from a base 30 defining a longitudinal axis, the base having a first end and a second end.

FIG. 9 is a view of the bracelet jewelry shown in FIG. 8 with the item (charm) 22 reversibly locked within its respective base, 30. Here, the charm is shown rotated 90 degrees compared to when it is first aligned for mating with the base in FIG. 8. This position shows a rotary element 40 with a similar cross section to that as the base so as to define an aperture to slidably receive an elongated substrate, such as a necklace. The rotary element rotatably communicates with either the first or the second end of the base. A depending surface of the base defines a slot adapted to removably receive the rotatable element 40 such that when that element fully nests within the base, it too defines an aperture to slidably receive an elongated substrate.

Figure 10:
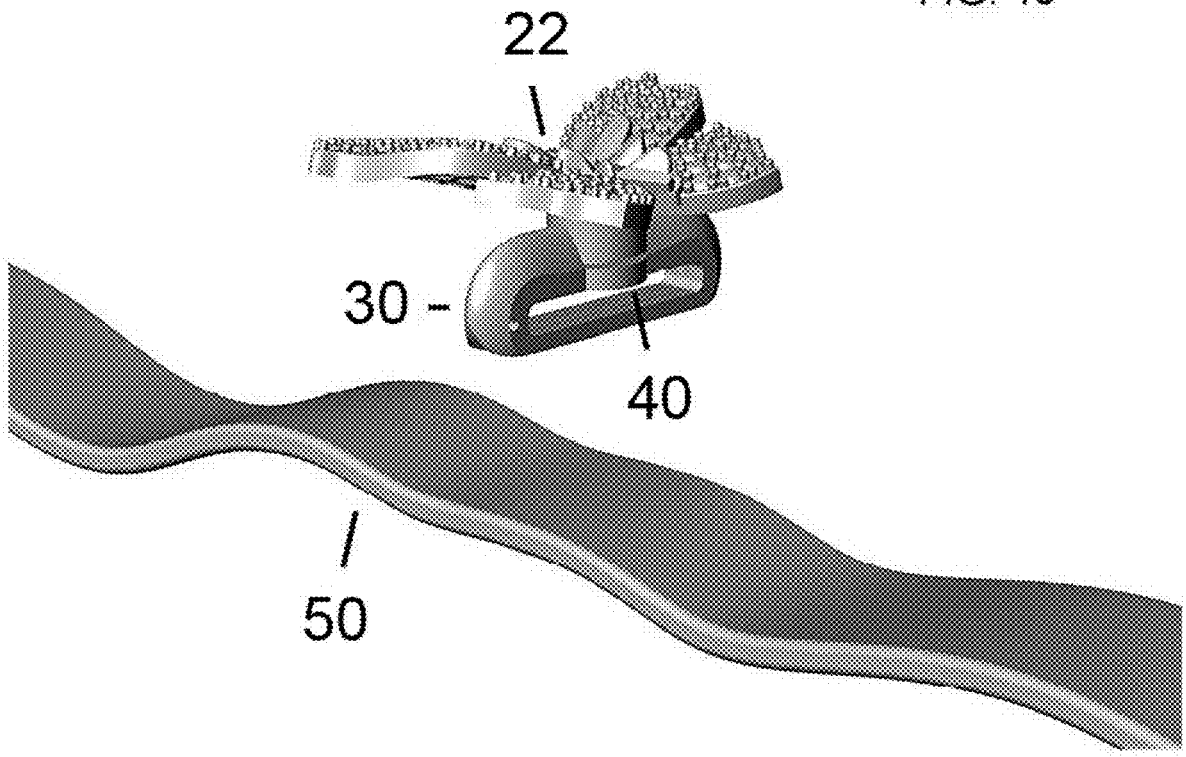
FIG. 10 shows the device with the locked-in charm and positioned above the aforementioned bracelet substrate.
Figure 11:
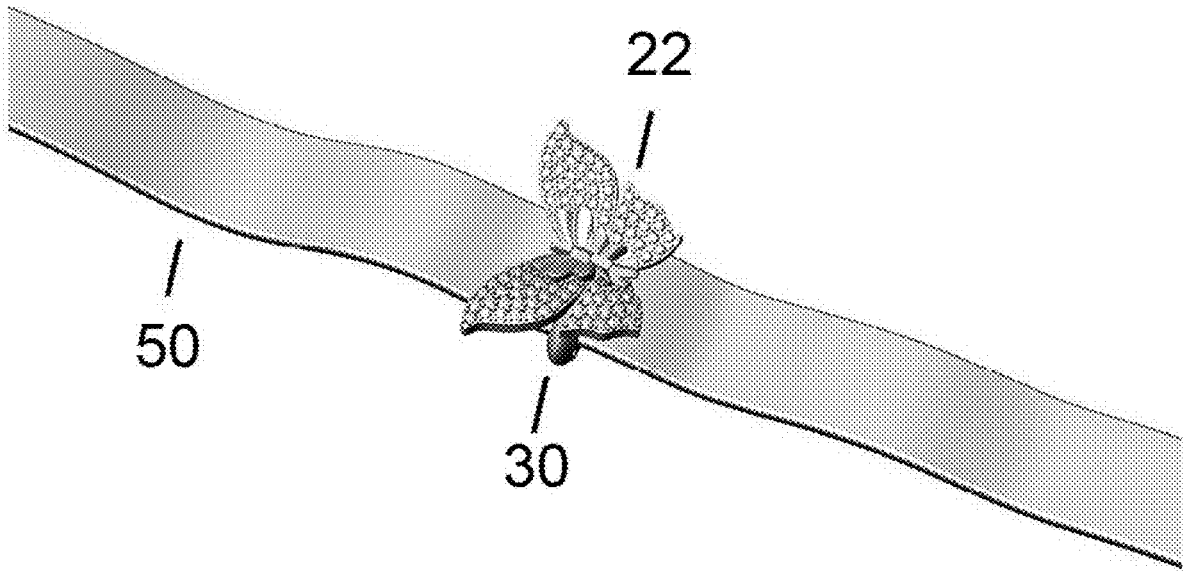
FIG. 11 shows the device mated with the elongated substrate 1.

FIG. 10 shows the device with the locked-in item (charm) 22 and positioned above the aforementioned elongated substrate 50. FIG. 11 shows the device mated with the elongated substrate 50.

It is noteworthy that with the device mounted to the elongated substrate, the item (charm) 22 is not removable. Rather, only after the charm is decoupled with the elongated substrate 50 can the rotatable element 40 be deployed from within the base and the charm rotated back 90 degrees for decoupling from a top surface of the base 30. This allows for a different mounting to be mated with the base.

Figure 12:
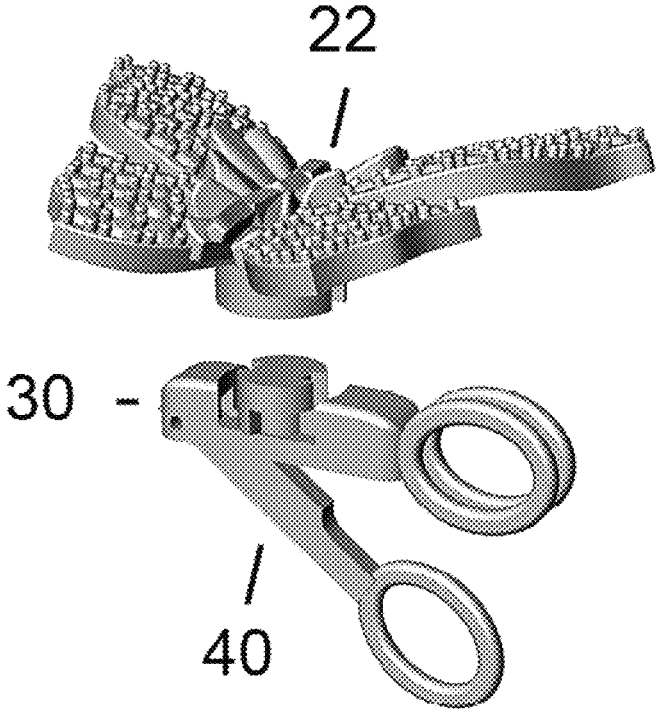
FIG. 12 is an exploded view of a pendant embodiment of the invention.

FIGS. 12-16 show the invention as it enables the assembly of pendants. FIG. 12 is an exploded view of this embodiment of the invention. It shows an item (charm) 22 positioned above a base 30. A rotary element 40 is in rotatable communication with the base 30 and is seen in FIG. 12 as undeployed, relative to the base. As described supra, the rotatable element is adapted to be received within the base via an aperture formed along the underside of the longitudinal axis of the base 30.

Figure 13:
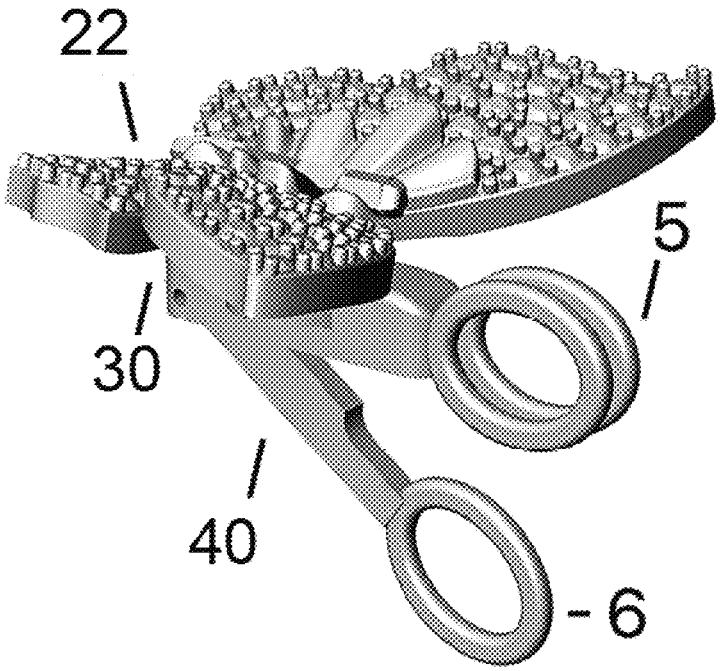
FIG. 13 is a view of the assembled pendant with the object charm rotated to lock upon the base, in accordance with features of the present invention.

FIG. 13 shows the charm 22 engaged with the base 30 to form an assembled jewelry piece. At this point in the assembly, the charm has been rotated 90 degrees clockwise to arrive at its locking position.

Figure 14:
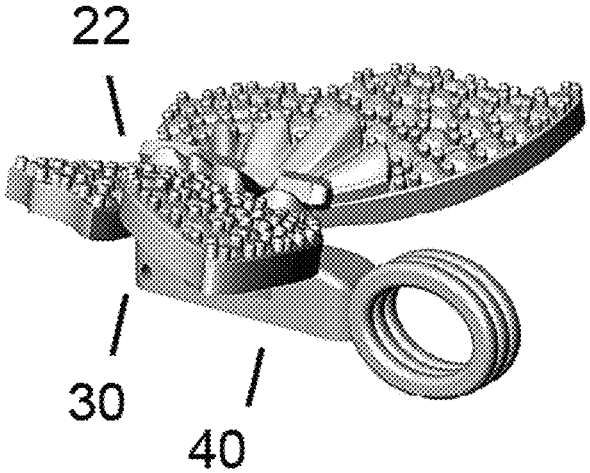
FIG. 14 is a view of the assembled pendant with locking arms forming an aperture adapted to receive a pendant string, in accordance with features of the present invention.

FIG. 14 shows the rotary element 40 fully nested within the base, such that its aperture is coaxial with the aperture formed by the base through which a pendant chain may pass. In this configuration, the item 22 cannot be rotated counterclockwise 90 degrees and removed from the item.

Figure 15:
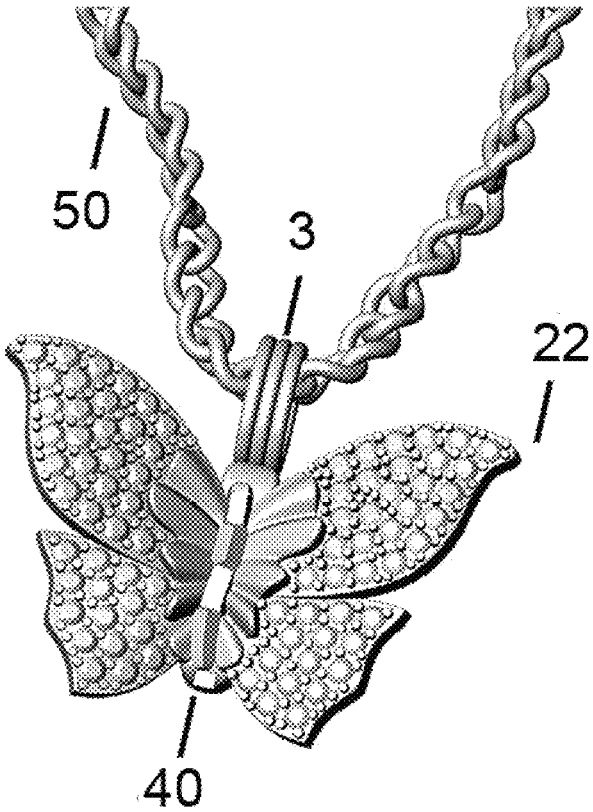
FIG. 15 is a view of the pendant upon the pendant string.

FIG. 15 shows the fully assembled and locked down charm engaged with a pendant chain 50.

FIGS. 16-19 show a device and method for assembling an earring charm. FIG. 16A shows an exploded view of the system, which includes the carrier 50 (in this case the ring), the item (charm) 22, the base 30 positioned below the charm and upon which the charm is ultimately mounted, and the rotary member 40 which is in rotatable communication with the base. The action of the rotary member 40 relative to the base is very similar to that described supra. A first loop 35 ultimately mates with a second loop 36 in a coplanar and hinged interaction to form a mounting ring.

Figure 16A:
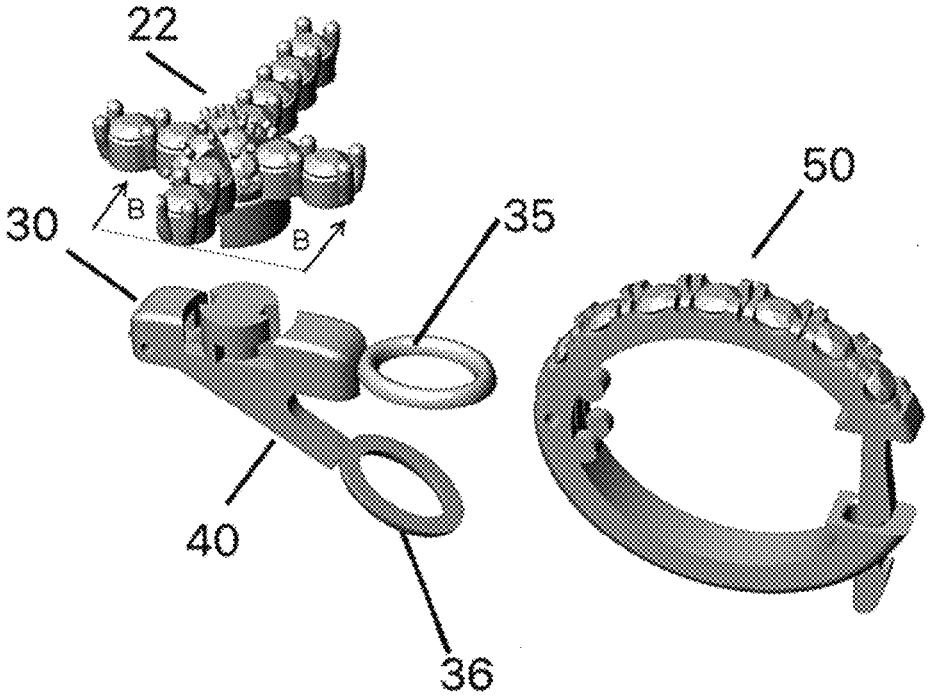
FIG. 16A is an exploded view of an ear ring pendant, in accordance with features of the present invention.
Figure 16B:
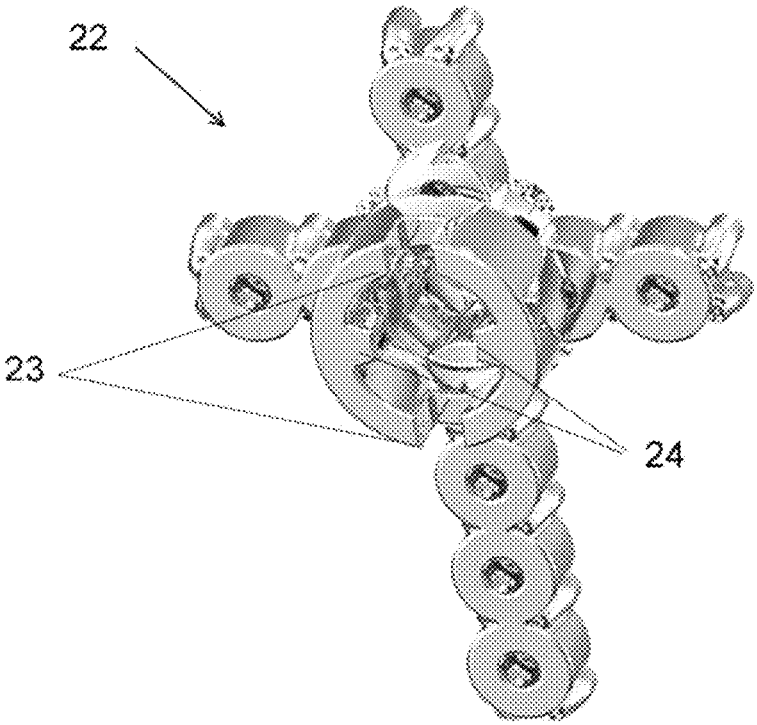
FIG. 16 B is a view of 16A taken along line B-B'

FIG. 16B is a view of FIG. 16A taken along line B-B. A depending end of the decorative item 22 defines a socket 23 adapted to slidably receive the afore-described boss 6. The socket 23 has a closed, first proximal end defining a floor or terminating surface of the interior of the socket. An opposing side of that surface supports the item 22. The socket 23 defines one or more longitudinally extending, diametrically opposed medially extending protuberances 24 which are adapted to be slidably received by the afore-described longitudinally extending grooves 9 of the boss. 6. Once mated, the decorative item 22 is rotated as described supra to reversibly lock onto the boss.

Figure 17:
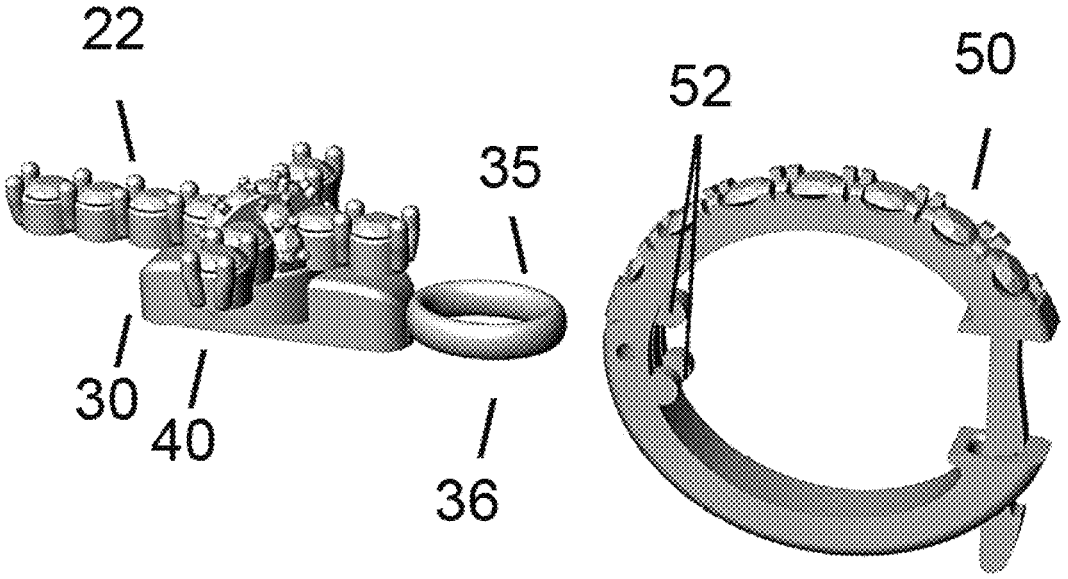
FIG. 17 is view of the ear ring pendant with the charm mounted onto the base of the pendant, in accordance with features of the present invention.
Figure 18:
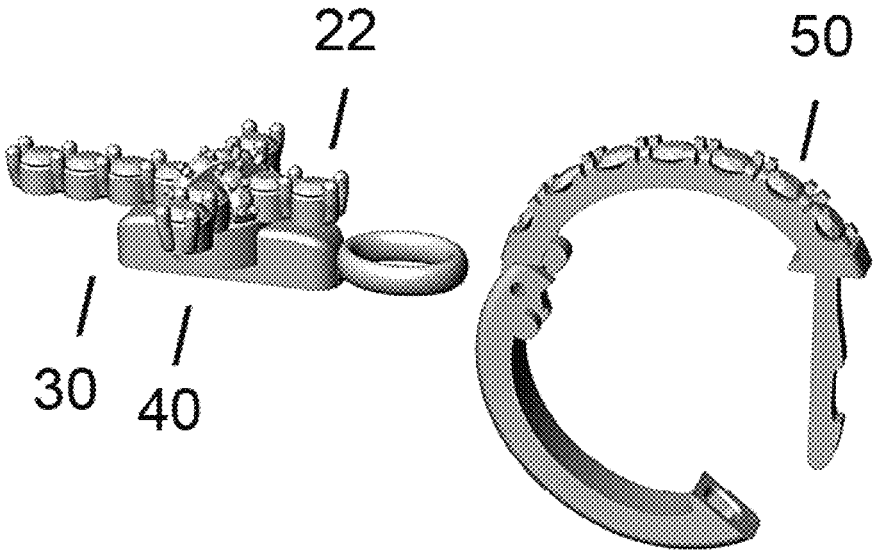
FIG. 18 is a view of the ear ring pendant not yet assembled to the ear ring.
Figure 19:
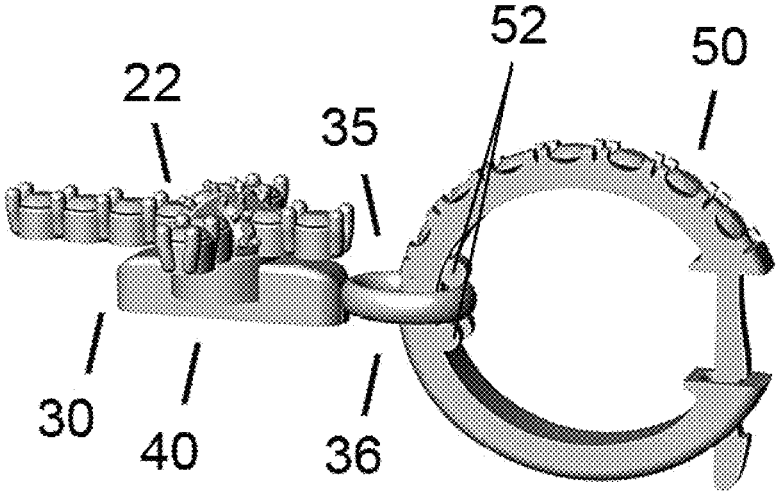
FIG. 19 is a view of the ear ring pendant locked in place on an ear ring, in accordance with features of the present invention.

FIG. 17 shows the item (charm) 22 mounted to the base and the rotary member 40 rotated to fully nest within the base 30. The nested position of the rotary member aids in locking the charm upon the base. As previously described, the item (charm) 22 is rotated 90 degrees to effect locking. Securement to the carrier occurs via medially directed protuberances 52 on the ear ring provide medial pressure on the mounting ring of the base when the pendant is positioned within the base, as shown in FIG. 19, so as to reside between the protuberances. The protuberances are spaced from each other a first distance that is slightly larger than the width of the combined loops 35, 36. Therefore, these protuberances prevent the rings 35 and 36 from opening via frictional interaction when the clasp of the earring is actuated. FIG. 18 shows the pendant not yet mounted to the ear ring, wherein the ear ring is in an open position and therefore the clasp not actuated.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope.

Specifically, the system may be utilized to mount a plurality of items to a carrier substrate, such as light fixtures along a race way, or beads along a string. While the dimensions and types of materials described herein are intended to define the parameters of the invention, they are by no means limiting, but are instead exemplary embodiments. Many other embodiments will be apparent to those of skill in the art upon reviewing the above description.

The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The invention claimed is:

1. A system for mounting discrete objects, the system comprising:

a) a base having a first end forming a first ring; and b) a lever having a second end forming a second ring, the lever in rotatable communication with the base such that in a first configuration, the first ring and the second ring are not aligned and in a second configuration the lever is nested within the base such that the second ring is coaxial with the first ring to form a loop, wherein the loop is adapted to receive a carrier wherein an item of jewelry is removably received to the base in a first position, then rotated to a second position, whereby the second position provides a first fastening configuration of the item of jewelry to the base.

2. The system as recited in claim 1 wherein the second ring being coaxial with the first ring provides a second fastening configuration of the item of jewelry to the base.

3. The system as recited in claim 1 wherein the carrier is an elongated substrate which passes through the loop.

4. The system as recited in claim 3 wherein the elongated substrate is a flexible elongated substrate selected from the group consisting of a necklace, a bracelet, a belt, and a cable and the loop.

5. A system for mounting discrete objects, the system comprising:

a) a base having a first end forming a first ring; and b) a lever having a second end forming a second ring, the lever in rotatable communication with the base such that in a first configuration, the first ring and the second ring are not aligned and in a second configuration the lever is nested within the base such that the second ring is coaxial with the first ring to form a loop, wherein the loop is adapted to receive a carrier, wherein the carrier is an earring and the earring frictionally engages with the loop when the earring is worn by a user wherein the earring defines medially extending protuberances spaced from each other a first distance that is slightly larger than a width of the loop.

* * * * *